US010815863B2

(12) United States Patent
Diekmann et al.

(10) Patent No.: US 10,815,863 B2
(45) Date of Patent: Oct. 27, 2020

(54) LIQUID PUMP

(71) Applicant: Mahle International GmbH, Stuttgart (DE)

(72) Inventors: Johannes Diekmann, Schorndorf (DE); Thorsten Grelle, Karlsruhe (DE); Michael Krappel, Stuttgart (DE); Gunnar Schmitt-Sauter, Stuttgart (DE); Benjamin Weimann, Stuttgart (DE)

(73) Assignee: MAHLE INTERNATIONAL GMBH (DE)

( * ) Notice: Subject to any disclaimer, the term of this patent is extended or adjusted under 35 U.S.C. 154(b) by 0 days.

(21) Appl. No.: 16/339,357

(22) PCT Filed: Sep. 1, 2017

(86) PCT No.: PCT/EP2017/071984
§ 371 (c)(1),
(2) Date: Apr. 3, 2019

(87) PCT Pub. No.: WO2018/065155
PCT Pub. Date: Apr. 12, 2018

(65) Prior Publication Data

US 2019/0242291 A1 Aug. 8, 2019

(30) Foreign Application Priority Data

Oct. 6, 2016 (DE) ..... 10 2016 219418

(51) Int. Cl.
*F01P 5/10* (2006.01)
*F04D 29/42* (2006.01)

(52) U.S. Cl.
CPC ..... *F01P 5/10* (2013.01); *F04D 29/4293* (2013.01); *F05D 2250/51* (2013.01)

(58) Field of Classification Search
CPC ..... F01P 5/10; F01P 5/00; F01P 7/14; F01P 11/02; F01P 11/0214
(Continued)

(56) References Cited

U.S. PATENT DOCUMENTS 10,036,401 B2 7/2018 Hackett et al.
2004/0237912 A1* 12/2004 Pawellek ..... F01P 5/10 123/41.44

FOREIGN PATENT DOCUMENTS

CN 205478357 U 8/2016
DE 10207653 C1 9/2003
(Continued)

OTHER PUBLICATIONS

English abstract for DE-102014113412.
English abstract for DE-102008030768.

*Primary Examiner* — Moshe Wilensky
*Assistant Examiner* — Jason Mikus
(74) *Attorney, Agent, or Firm* — Fishman Stewart PLLC

(57) ABSTRACT

A liquid pump for conveying a liquid may include a housing, in which a pump impeller is arranged for conveying the liquid, and a cover for covering the housing. The cover may include a main connector for supplying a main flow of the liquid to the pump impeller and an auxiliary connector for supplying an auxiliary flow of the liquid to the pump impeller. The housing may have an inlet opening for the liquid and an annular collar protruding from an edge of the inlet opening. The cover may lie axially against the annular collar. The annular collar and the cover may define an annular wall surrounding a flow path of the main flow of the liquid. The annular wall may have at least one radial opening connecting the flow path with an inflow space surrounding the annular wall. The auxiliary connector may be fluidically connected with the inflow space.

20 Claims, 3 Drawing Sheets

(58) Field of Classification Search
USPC ..... 415/116
See application file for complete search history.

(56) References Cited

FOREIGN PATENT DOCUMENTS

| | | | | | |
|---|---|---|---|---|---|
| DE | 102008030768 | A1 | 12/2009 | | |
| DE | 102014113412 | B3 | 9/2015 | | |
| EP | 2597370 | A1 * | 5/2013 | ..... | F23D 15/36 |
| EP | 3064778 | A1 | 9/2016 | | |
| WO | 2007/025375 | A3 | 4/2007 | | |
| WO | WO-2017036837 | A1 * | 3/2017 | ..... | H02K 11/33 |

* cited by examiner

LIQUID PUMP

CROSS-REFERENCE TO RELATED APPLICATIONS

This application claims priority to International Patent Application No. PCT/EP2017/071984 filed on Sep. 1, 2017, and German Patent Application No. DE 10 2016 219 418.6 filed on Oct. 6, 2016, the contents of each are hereby incorporated by reference in their entirety.

TECHNICAL FIELD

The present invention relates to a liquid pump for conveying a liquid, having a pump impeller arranged in a housing, and a cover for covering the housing.

BACKGROUND

In numerous applications, it is desirable, by means of a liquid pump, in addition to a main flow of a liquid, for example in a first circuit, to also convey an auxiliary flow of the liquid, for example in a second circuit. When the liquid pump is, for example, configured as a coolant pump, it is possible hereby to convey coolant from two different cooling circuits by means of the coolant pump.

Such a liquid pump, configured as a coolant pump, is known from DE 10 2014 113 412 B4. In this coolant pump, a pump impeller for conveying the coolant is arranged in a housing of the coolant pump, wherein the housing is covered by means of a cover. The cover is configured so as to be hemispherical or respectively bell-shaped and has a main connector for supplying a main flow of the coolant to the pump impeller, which protrudes axially from the cover on the side of the cover facing away from the housing. An auxiliary connector is provided spaced apart from the main connector and protruding radially from the cover, for supplying an auxiliary flow of the coolant to the pump impeller.

A disadvantage in such liquid pumps are, in particular, the high installation space requirement and the rigid specification of the arrangement of the auxiliary connector.

SUMMARY

The present invention is therefore concerned with the problem of indicating, for a liquid pump of the type mentioned in the introduction, an improved or at least different embodiment, which is distinguished by a reduced installation space requirement and/or more variable arrangement of the auxiliary connector.

This problem is solved according to the invention by the subject of the independent claim(s). Advantageous embodiments are the subject of the dependent claim(s).

The present invention is based on the general idea of realizing, at an inlet opening of a housing of a liquid pump for letting in a liquid which is to be conveyed, both the supplying of a main flow of the liquid and also the supplying of an auxiliary flow to the liquid to a pump impeller of the liquid pump. Hereby, the dimensioning of the liquid pump and therefore the required installation space can be distinctly reduced. It is also therefore possible to arrange on the housing an auxiliary connector for supplying the auxiliary flow of the liquid in any desired manner, at least with a greater variability.

According to the idea of the invention, the liquid pump therefore has the housing in which the pump impeller for supplying the liquid is arranged. The housing is covered by a cover, wherein the cover has a main connector for supplying the main flow of the liquid to the pump impeller, and the auxiliary connector for supplying the auxiliary flow of the liquid to the pump impeller. According to the invention, the housing has an annular collar which protrudes axially from an edge of the inlet opening, wherein the cover lies against the annular collar in the region of the main connector. Therefore, the annular collar and the cover form an annular wall, which surrounds a flow path of the main flow of the liquid. In the annular wall now at least one radial opening is formed, which connects the flow path of the main flow with an inflow space surrounding the annular wall, which inflow space is fluidically connected to the auxiliary connector. The auxiliary flow of the liquid therefore arrives via the auxiliary connector and the inflow space through the at least one opening to the main flow, so that in the region of the annular wall a total flow arises, which arrives at the pump impeller for the purpose of conveying the liquid.

The annular collar and the inlet opening can form here in particular a suction port of the liquid pump, through which the main flow and the auxiliary flow together arrive at the pump impeller.

The edge of the inlet opening, from which the annular collar protrudes, preferably adjoins radially the inlet opening. However, it is also conceivable to arrange the edge, and therefore the annular collar, spaced apart radially from the inlet opening.

The at least one opening can basically be arranged in any desired manner in the annular wall.

Embodiments are conceivable in particular in which at least one such opening is formed in the annular collar. Configurations are also conceivable in which at least one such opening is formed in the cover, in particular in the main connector. In addition, it is possible that at least one such opening is formed in the annular collar and in the cover, in particular in the main connector.

In advantageous embodiments, the inflow space, which fluidically connects at least one such opening with the auxiliary connector, is formed between the housing and the cover. The inflow space can therefore be formed in particular by a cavity provided between the housing the cover. Hereby, the liquid pump can be realized in a simple manner and/or at a favourable cist and/or in a space-saving manner.

In so far as the annular wall has at least two such openings, it is preferred if these openings are arranged spaced apart, preferably spaced apart uniformly, in a circumferential direction of the annular wall, in particular of the annular collar. Hereby, a uniform mixing of the main flow and of the auxiliary flow of the liquid can be already achieved in the region of the annular wall.

The housing in which the pump impeller is arranged can basically be formed in any desired manner. It is conceivable in particular to form the housing in a spiral shape or as a spiral housing, in which the pump impeller is arranged and to which the liquid is supplied substantially axially and from which the liquid is discharged substantially radially. The spiral-shaped design of the housing leads in particular to a reduced installation space requirement of the liquid pump.

The inflow space, as mentioned above, fluidically connects at least one such opening with the auxiliary connector. Basically, the inflow space can be in fluidic contact here directly with the auxiliary connector. It is also conceivable to provide an intermediate duct between the inflow space and the auxiliary connector, which intermediate duct fluidically connects the inflow space with the auxiliary connector. The inflow space can therefore be, in particular, a component of an auxiliary duct which alongside the inflow space has a radial section adjoining at the inflow space and running radially, wherein the radial section fluidically connects the inflow space with the auxiliary connector. The auxiliary duct makes it possible here to provide the auxiliary connector in any desired manner on the housing. It is particularly preferred here if the auxiliary duct is formed entirely between the housing and the cover.

The cover can basically have any desired shape. It is preferred if the cover has a flat, radially extending wall on the side facing away from the housing, from which wall the main connector and/or the auxiliary connector protrude(s).

It is preferred if the main connector protrudes axially from the cover. Hereby, the connection possibility to the main connector for connecting the main connector, for example with an associated circuit, therefore the corresponding installation, is simplified.

It is preferred, in addition, if the auxiliary connector is arranged spaced apart from the main connector. Hereby, also, the corresponding installation on the main connector and the associated installation on the auxiliary connector, for example for connecting the auxiliary connector with an associated circuit, is facilitated.

It is also advantageous if the auxiliary connector runs in an inclined manner to the main connector.

According to advantageous variants, the housing has an axially protruding housing collar, which is arranged radially on the outside of the annular collar. The housing collar can be configured so as to be closed and encircling in circumferential direction. The cover lies here axially against the housing collar. Therefore, in particular a connection of the cover with the housing, in particular the installation and/or aligning of the cover on the housing, is simplified.

Embodiments prove to be advantageous, in which the cover has an axially protruding cover collar, which lies radially on the outside of the annular collar against the housing. The cover collar is advantageously configured so as to be encircling in circumferential direction and closed. The cover collar enables a simplified connection of the cover with the housing, in particular a simplified installation and/or aligning on the housing.

An advantageous embodiment of the liquid pump is achieved in that the housing collar of the housing is provided with a step on which a seal is arranged, and is pressed by the cover against the step for the purpose of sealing. Here, the seal can be arranged radially on the outside of the cover collar. It is particularly preferred if the seal is formed as a ring seal.

The cover can be produced in a one piece with the main connector and with the auxiliary connector, in particular from a single material, for example from plastic. In particular, it is conceivable to produce the cover as an injection-moulded part. The housing can also be produced in one piece, in particular from a single material, for example from plastic.

The liquid pump can basically be used for conveying any desired liquid. The liquid pump is used in particular in a motor vehicle for conveying a liquid in the motor vehicle. The use of the liquid pump is to be considered here for conveying a coolant, wherein the liquid pump conveys the coolant of a first cooling circuit, fluidically connected with the main connector, or of a main cooling circuit, and the coolant of a second cooling circuit or auxiliary cooling circuit, fluidically connected with the auxiliary connector.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 1:
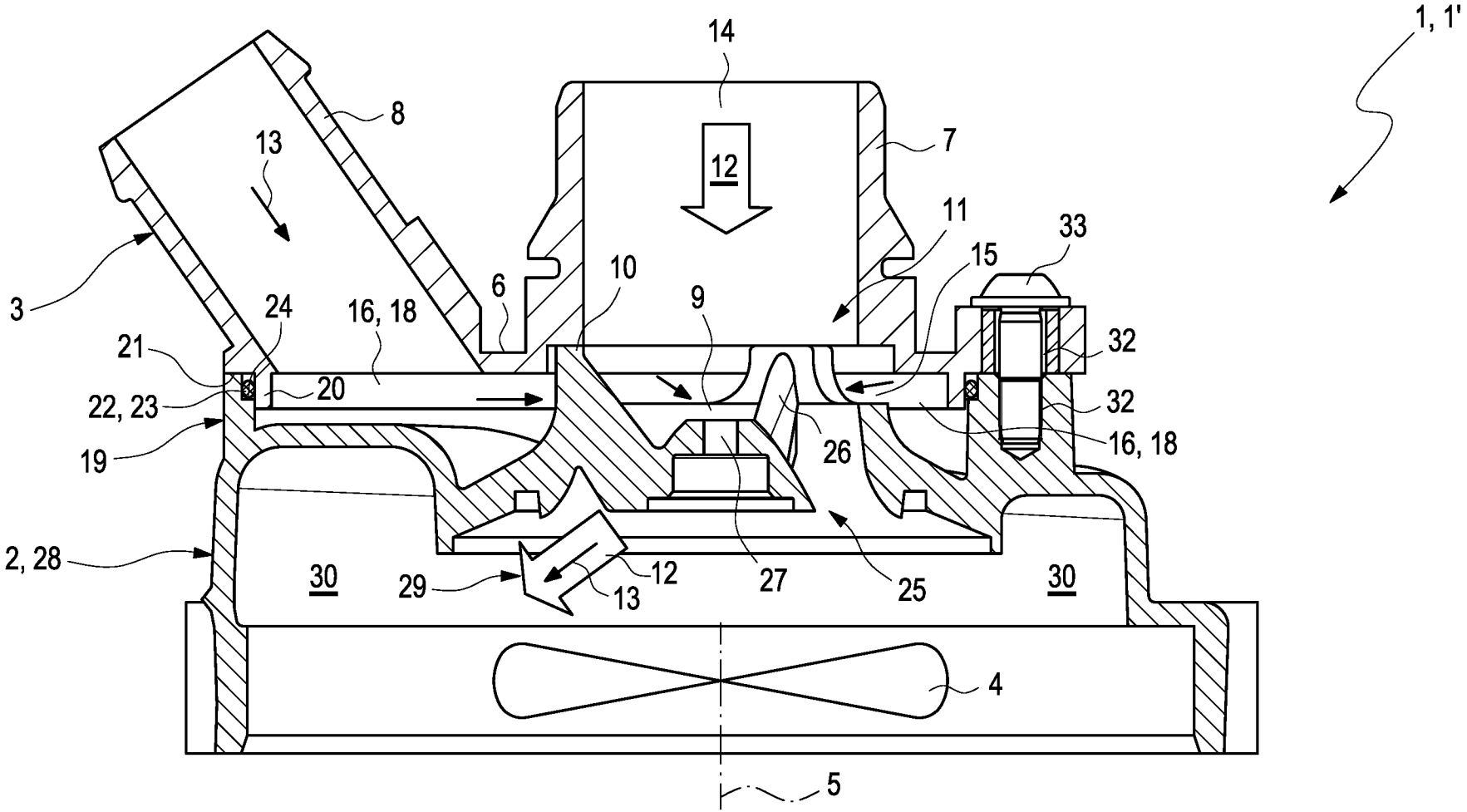
FIG. 1 shows a section through a liquid pump with a housing and with a cover.

In FIG. 1 a section can be seen through a liquid pump 1 for conveying a liquid, which can be configured here as a coolant pump 1' for the conveying of coolant. The liquid pump 1 has a housing 2 and a cover 3 for covering the housing 2. Here in FIG. 2 a three-dimensional view of the cover 2 onto the side facing the housing 2 is illustrated, whereas in FIG. 3 a three-dimensional view of the liquid pump 1 onto the side facing the cover 3 can be seen, but without cover 3. A liquid, in particular coolant, is conveyed by the liquid pump 1. For this, a pump impeller 4, which is illustrated only symbolically in FIG. 1, is arranged in the housing 2. The pump impeller 4 conveys the liquid by a turning or respectively rotation about a rotation axis 5. This rotation axis 5 defines an axial direction of the pump 1.

The cover 3 has, on the side facing away from the housing 2, a flat end wall 6, from which a main connector 7 and an auxiliary connector 8 protrude. The housing 2 has an inlet opening 9, from the edge of which an annular collar 10 protrudes axially. The main connector 7 protrudes axially from the cover 3 and is aligned substantially with the annular collar 10. The cover 3 lies in the region of the main connector 7, in particular with the main connector 7, axially against the annular collar 10, wherein the annular collar 10 and the cover 3, in particular in the contact region of the annular collar 10 with the main connector 7, form an annular wall 11. The auxiliary connector 8 is arranged spaced apart from the main connector 7 and runs in an inclined manner to the main connector 7, wherein the auxiliary connector 8 is arranged radially on the edge side of the cover 3. The main connector 7 serves for the supplying of a main flow 12 of the liquid to the pump impeller 4, whereas the auxiliary connector 8 serves for the supplying of an auxiliary flow 13 of the liquid to the pump impeller 4. With the liquid pump 1, it is therefore possible via the main connector 7 to convey liquid of a first circuit, in particular coolant in a first cooling circuit, and liquid via the auxiliary connector 8 in a second circuit, in particular coolant in a second cooling circuit. In the present case, the main connector 7 is concentric to the rotation axis 5, whereas the auxiliary connector 8 is eccentric thereto.

As can be seen in particular from FIG. 1, the annular wall 11 surrounds a flow path 14 of the main flow 12 of the liquid, delimits this in particular radially. In the annular wall 10 at least one radial opening 15 is formed, wherein in the example which is shown three such radial openings 15 are provided. The at least one radial opening 15 is fluidically connected with an inflow space 16 surrounding the annular wall 11, which inflow space fluidically connects the at least one opening 15 with the auxiliary connector 8. Accordingly, the main flow 12 and the auxiliary flow 13 are guided together in the region of the annular wall 11 or respectively of the at least one opening 15, and are guided via the shared inlet opening 9 to the pump impeller 4. Hereby, a total flow 29 of the liquid is produced, which is composed of the main flow 12 and of the auxiliary flow 13.

In the example which is shown, the openings 15 are formed in the annular collar 10, wherein the openings 15 are arranged spaced apart in a circumferential direction 17 and preferably distributed in a uniform manner. In addition, the inflow space 16 is formed between the cover 3 and the housing 2. In the example which is shown, the inflow space 16 forms an auxiliary duct 18, which is connected directly fluidically with the auxiliary connector 8.

The housing 2 has a housing collar 19, which surrounds the annular collar 10 radially externally, and is formed so as to be closed in the circumferential direction 17. In the example which is shown, the housing collar 19 is configured here so as to be oval (cf. FIG. 3). The cover 3 has a cover collar 20 protruding axially in the direction of the housing 2 and lying axially against the housing 2, which cover collar surrounds the annular collar 10 radially externally and is arranged radially between the housing collar 19 and the annular collar 10. The cover collar 20 delimits in addition the inflow space 16 radially externally. The cover collar 20 is arranged here radially inwardly offset on the cover 3, so that radially on the outside of the cover collar 20 a radial shoulder 21 of the cover 3, running in circumferential direction 17, is formed. The cover collar 20 has a complementary shape to the housing collar 19, is therefore in particular shaped so as to be oval (cf. in particular FIG. 2). Here, the cover 3 lies with its shoulder 21 axially against the housing collar 19. The cover collar 20 lies axially against the housing 2, wherein radially between the cover collar 20 and the housing collar 19 a seal 22, in particular a ring seal 23, is arranged. The seal 22 lies on a step 24 of the housing collar 19, wherein the seal 22 is compressed by the housing collar 19 and by the cover collar 20, in particular radially, in order to achieve a sealing of the liquid.

Figure 3:
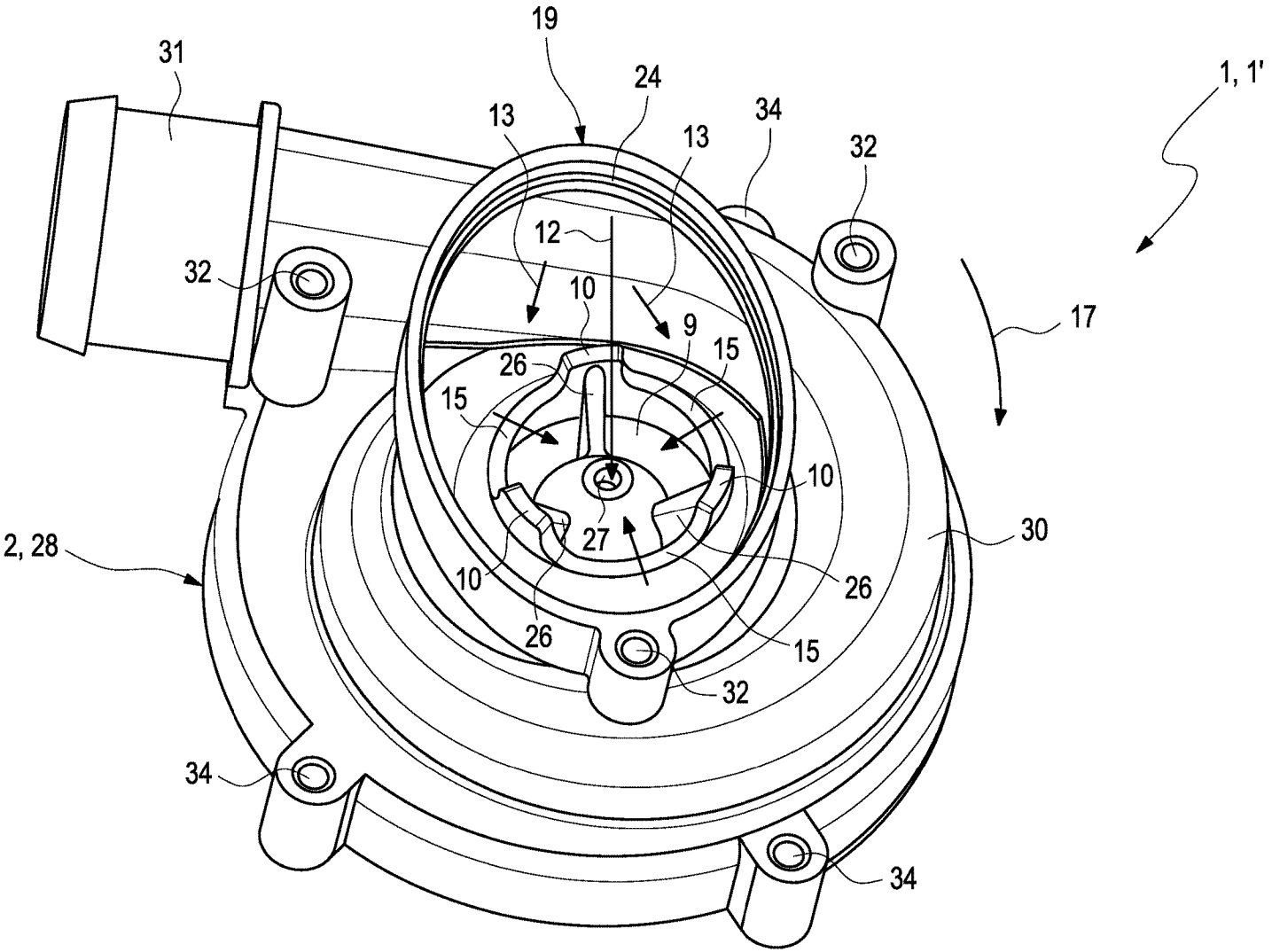
FIG. 3 shows an isometric view of the liquid pump without cover.

As can be seen in particular from FIG. 3, on the side of the inlet opening 9 facing away axially from the main connector 7, a tripod 25 is arranged, which outside the openings 15 is mechanically connected by legs 26 with the annular collar 10. The tripod 25 serves to receive an, in particular stationary, axis, which is not shown, which can serve for the mounting of the pump impeller 4. For this, the tripod 25 has a central opening 27. In addition, the tripod 25 can serve to receive or fasten an axial thrust bearing, which is not shown. In addition, the tripod 25 leads to a stabilizing of the housing 2 in the region of the inlet opening 9.

As can be seen in particular in FIG. 3, the housing 3 is configured in a spiral shape or respectively as a spiral housing 28. The liquid arrives here through the inlet opening 9 axially into the housing and is conveyed radially outwards by the pump impeller 4. The liquid which is thus conveyed arrives into an outlet duct 30, radially surrounding the pump impeller 4, which outlet duct runs in a spiral shape and is fluidically connected with the outlet connector 31, such that the conveyed liquid can be discharged via the outlet connector 31 by the liquid pump 1.

Figure 2:
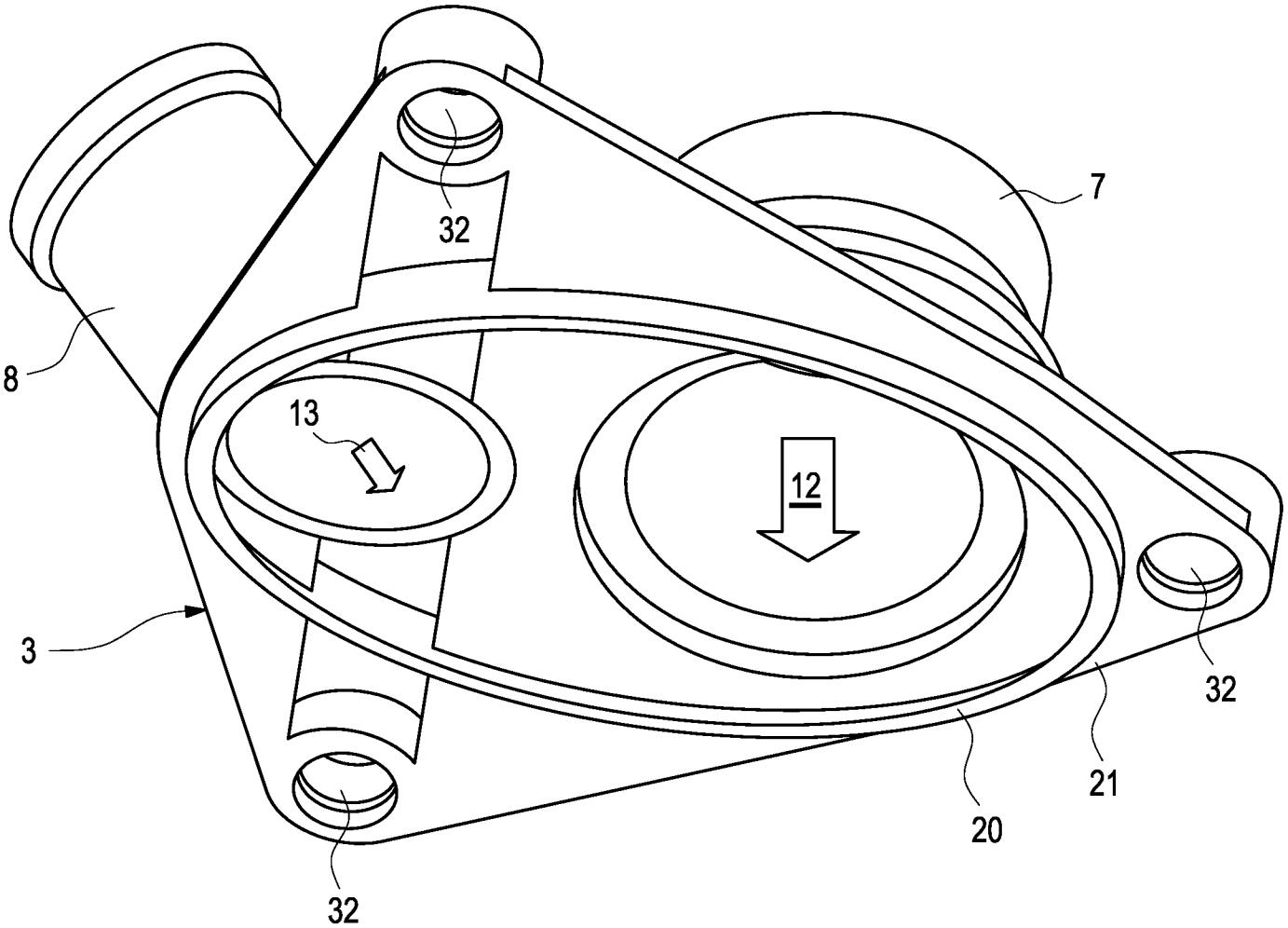
FIG. 2 shows an isometric view of the cover from the side facing the housing.

It can be seen from FIGS. 2 and 3 that the housing 2 and the cover 3 have complementary connection openings 32, which serve for the mechanical connection of the cover 3 with the housing 2. In the example which is shown, this mechanical connection takes place through respectively a screw 33 guided through the associated connection openings 32 (cf. FIG. 1), wherein also other connection means are conceivable. Here, in the example which is shown, respectively three such connection openings 32 are provided, which form the corners of a virtual triangle which is not illustrated.

Radially on the outside of the connection openings 32 the housing 2 has further connection structures 34, which in the example which is shown are also formed as openings. The connection structures 34 serve for connecting the liquid pump 1 with an associated application, for example with an associated motor vehicle, which is otherwise not shown. It is also conceivable to use the connection structures 34 for connecting the housing 2 with further components of the liquid pump 1, which are not shown.

The cover 3 is produced in one piece with the main connector 7 and the auxiliary connector 8, in particular from a single material, for example from plastic. The housing 2 can also be produced in one piece, in particular from a single material, for example from plastic.

The invention claimed is:

1. A liquid pump for conveying a liquid, comprising:

a housing in which a pump impeller is arranged for conveying the liquid;

a cover for covering the housing, the cover including a main connector for supplying a main flow of the liquid to the pump impeller and an auxiliary connector for supplying an auxiliary flow of the liquid to the pump impeller;

the housing having an inlet opening for the liquid and an annular collar protruding from an edge of the inlet opening;

the cover, in a region of the main connector, lying axially against the annular collar, the annular collar and the cover defining an annular wall which surrounds a flow path of the main flow of the liquid;

the annular wall having at least one radial opening connecting the flow path with an inflow space surrounding the annular wall; and wherein the auxiliary connector is fluidically connected with the inflow space.

2. The liquid pump according to claim 1, wherein the at least one radial opening is at least partially defined by the annular collar.

3. The liquid pump according to claim 1, wherein the at least one radial opening is at least partially defined by the cover.

4. The liquid pump according to claim 3, wherein the at least one radial opening is at least partially defined by the main connector.

5. The liquid pump according to claim 1, wherein the inflow space is defined between the housing and the cover.

6. The liquid pump according to claim 1, wherein the at least one radial opening includes at least two radial openings spaced apart from one another in a circumferential direction of the annular wall.

7. The liquid pump according to claim 1, wherein the housing is configured as a spiral housing.

8. The liquid pump according to claim 1, wherein the inflow space defines a portion of an auxiliary duct, the auxiliary duct having a radial section adjoining the inflow space and extending radially relative to the annular collar, the radial section fluidically connecting the inflow space with the auxiliary connector.

9. The liquid pump according to claim 1, wherein the main connector protrudes axially from the cover relative to the annular collar.

10. The liquid pump according to claim 1, wherein the auxiliary connector is arranged spaced apart from the main connector and protrudes from the cover transversely to the main connector.

11. The liquid pump according to claim 1, wherein the housing includes a housing collar arranged radially on an outside of the annular collar and protruding axially from the housing relative to the annular collar, against which the cover lies axially.

12. The liquid pump according to claim 11, wherein the housing collar includes a step on which a seal is arranged, and wherein the seal is pressed, via the cover, against the housing collar.

13. The liquid pump according to claim 1, wherein the cover includes an axially protruding cover collar, which lies radially on an outside of the annular collar against the housing.

14. The liquid pump according to claim 1, wherein:

the housing includes a mounting portion disposed within the inlet opening and coupled to the annular collar; and the pump impeller is mounted in the housing via the mounting portion.

15. The liquid pump according to claim 14, wherein the mounting portion includes a plurality of support legs projecting from the mounting portion and coupled to a radially inward facing surface of the annular collar.

16. The liquid pump according to claim 15, wherein:

the at least one radial opening includes a plurality of radial openings disposed circumferentially spaced apart from one another relative to the annular collar; and the plurality of support legs are connected to the annular wall between the plurality of radial openings such that the plurality of support legs and the plurality of radial openings are disposed in an alternating manner in a circumferential direction of the annular collar.

17. The liquid pump according to claim 1, wherein:

the cover includes an annular step disposed in the region of the main connector surrounding the flow path; and the annular collar engages the annular step such that the cover, in the region of the main connector, lies axially against the annular collar.

18. The liquid pump according to claim 1, wherein a surface of the main connector that at least partially defines the flow path is arranged flush with a radially inner surface of the annular collar that at least partially defines the flow path.

19. A liquid pump for conveying a liquid, comprising:

a housing in which a pump impeller is arranged for conveying the liquid;

a cover for covering the housing, the cover including a main connector for supplying a main flow of the liquid to the pump impeller and an auxiliary connector for supplying an auxiliary flow of the liquid to the pump impeller;

the housing having an inlet opening for the liquid and an annular collar protruding from an edge of the inlet opening;

the cover, in a region of the main connector, lying axially against the annular collar, the annular collar and the cover defining an annular wall which surrounds a flow path of the main flow of the liquid;

the annular wall having at least one radial opening connecting the flow path with an inflow space surrounding the annular wall;

wherein the auxiliary connector is fluidically connected with the inflow space;

wherein the main connector protrudes axially from the cover relative to the annular collar; and wherein the auxiliary connector is arranged spaced apart from the main connector and protrudes from the cover in an inclined manner relative to the main connector.

20. A liquid pump for conveying a liquid, comprising:

a housing in which a pump impeller is arranged for conveying the liquid;

a cover for covering the housing, the cover including a main connector for supplying a main flow of the liquid to the pump impeller and an auxiliary connector for supplying an auxiliary flow of the liquid to the pump impeller;

the housing having an inlet opening for the liquid and an annular collar protruding from an edge of the inlet opening;

the cover, in a region of the main connector, lying axially against the annular collar, the annular collar and the cover defining an annular wall which surrounds a flow path of the main flow of the liquid;

the annular wall having at least one radial opening connecting the flow path with an inflow space surrounding the annular wall, the inflow space defined between the housing and the cover; and wherein the inflow space defines a portion of an auxiliary duct, the auxiliary duct having a radial section adjoining the inflow space and extending radially relative to the annular collar, the radial section fluidically connecting the inflow space with the auxiliary connector.

* * * * *